US005408160A

United States Patent [19]

Fox

[11] Patent Number: 5,408,160

[45] Date of Patent: Apr. 18, 1995

[54] GAS DISCHARGE ELECTRODES

[75] Inventor: Neil A. Fox, Evesham, England

[73] Assignee: Smiths Industries Public Limited Company, London, England

[21] Appl. No.: 97,013

[22] Filed: Jul. 27, 1993

[30] Foreign Application Priority Data

Aug. 7, 1992 [GB] United Kingdom ..... 9216785

[51] Int. Cl.[6] ..... H01J 61/04

[52] U.S. Cl. ..... 313/494; 313/631; 313/632; 313/574; 313/491

[58] Field of Search ..... 313/631, 632, 574, 634, 313/293, 297, 491, 494

[56] References Cited

U.S. PATENT DOCUMENTS

| | | | |
|---|---|---|---|
| 5,063,324 | 11/1991 | Grunward | 313/632 X |
| 5,111,109 | 5/1992 | Yagi et al. | 313/632 X |
| 5,142,196 | 8/1992 | Fox | 313/631 |
| 5,327,045 | 7/1994 | Fox | 313/632 X |

FOREIGN PATENT DOCUMENTS

| | | |
|---|---|---|
| 384857 | 12/1932 | United Kingdom . |
| 669679 | 4/1952 | United Kingdom . |
| 701589 | 12/1953 | United Kingdom . |
| 1222089 | 2/1971 | United Kingdom . |
| 2244855 | 12/1991 | United Kingdom . |
| 88/00758 | 1/1988 | WIPO . |
| 89/12905 | 12/1989 | WIPO . |

*Primary Examiner*—Sandra L. O'Shea
*Assistant Examiner*—Ashok Patel
*Attorney, Agent, or Firm*—Pollock, VandeSande and Priddy

[57] ABSTRACT

Electrodes 11 and 12 in a cold-cathode discharge lamp have a row of holes 13 arranged side-by-side along their length. The holes are formed by laser machining and extend at an angle of between about 25° and 35° to the normal, the holes in the two electrodes being oppositely inclined.

12 Claims, 2 Drawing Sheets

GAS DISCHARGE ELECTRODES

BACKGROUND OF THE INVENTION

This invention relates to electrodes for cold-cathode discharge lamps.

Conventional gas discharge lamps take one of two forms. They are either of the hot-cathode or cold-cathode kind. In the hot-cathode kind, the electrodes are heated so that electrons are emitted from the cathode by primary emission; in the cold-cathode kind, ion bombardment of the cathode causes the secondary emission of electrons. Although hot-cathode lamps have a greater electrical efficiency, cold-cathode lamps have the advantage of a considerably longer life and maintain a more constant brightness over their life than hot-cathode lamps.

The electrodes of cold-cathode lamps are generally hollow, that is, they take the shape of a short tube having an open end and a closed end, the open end facing the opposite electrode. Electrodes of this shape have been found to produce a more stable discharge and require lower operating voltages than flat plate electrodes.

In GB 2244855 it is proposed to form the electrodes of a flat panel cold-cathode discharge lamp from blocks of conductive material extending along opposite sides of the lamp. The electrodes are machined with slots which extend across the width of the electrode between the two glass plates to form regions of high current density. It has been found that, with prolonged use, metal can be sputtered out of the slots onto the glass plates, leading to discoloration.

BRIEF SUMMARY OF THE INVENTION

It is an object of the present invention to provide an improved electrode for use in a cold-cathode lamp.

According to one aspect of the present invention there is provided an electrode for use in a planar cold-cathode discharge lamp, the electrode being in the form of an elongate block of electrically-conductive material with a plurality of holes arranged side-by-side along the electrode, each hole having a width less than that of the electrode.

The spacing between the holes may be substantially equal to their width, the holes preferably being of circular section with a diameter of about 0.45 mm. The holes preferably extend at an angle away from the normal to the surface of the electrode between about 25 and 35 degrees. The holes preferably extend only a part way through the depth of the block and may be formed by laser machining. The block may be of a metal.

According to another aspect of the present invention there is provided a discharge lamp including two electrodes at least one of which is according to the above-mentioned one aspect of the invention. Where both electrodes are according to the one aspect of the invention and the holes extend at an angle to the normal, the holes in the two electrodes may be inclined in opposite senses. The lamp may have two plates supported by an array of pillars located between the two electrodes.

A gas discharge lamp including electrodes, in accordance with the present invention, will now be described, by way of example, with reference to the accompanying drawings.

DETAILED DESCRIPTION OF THE PREFERRED EMBODIMENT

Figure 1:
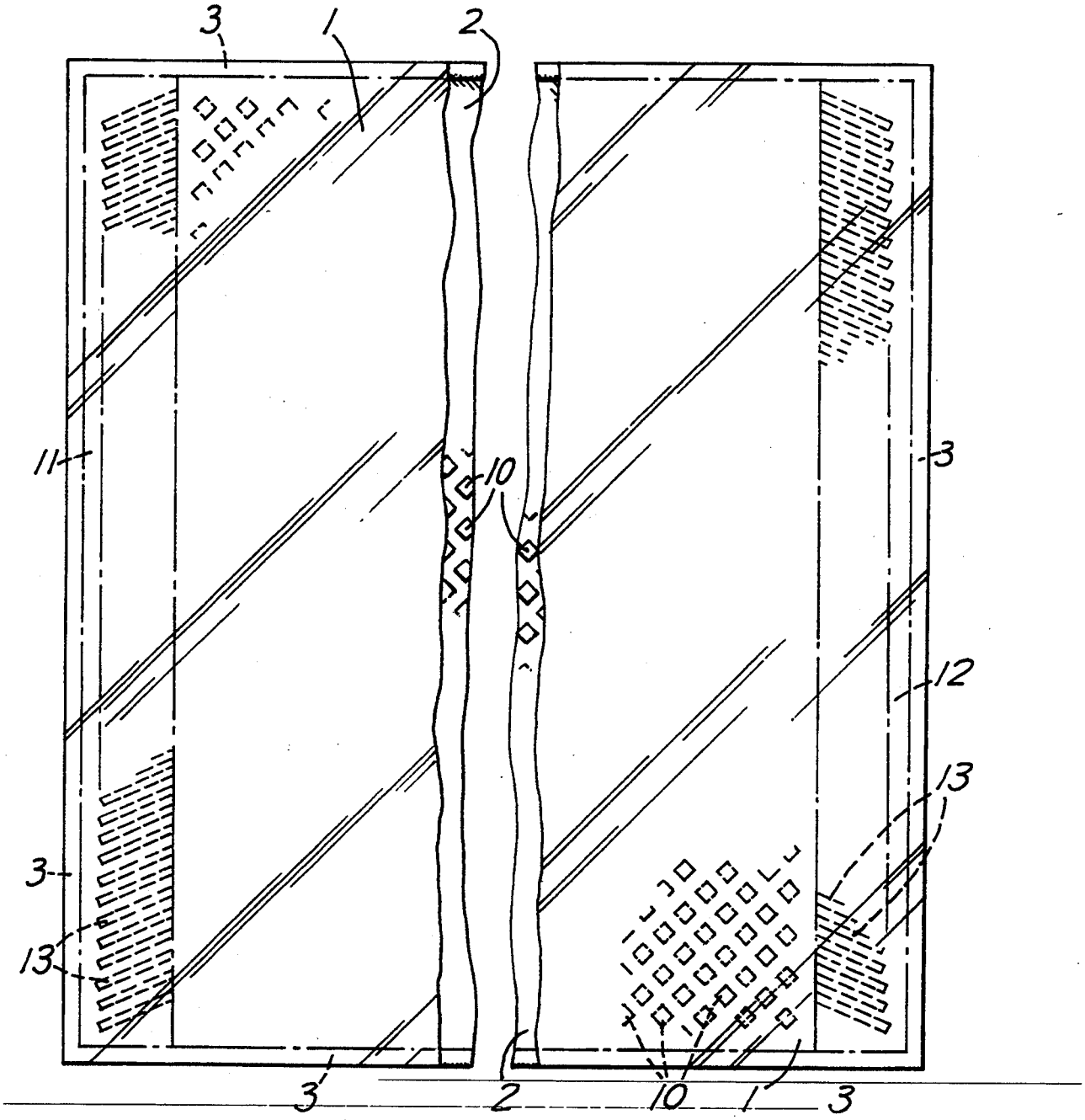
FIG. 1 is a plan view of the lamp.
Figure 2:
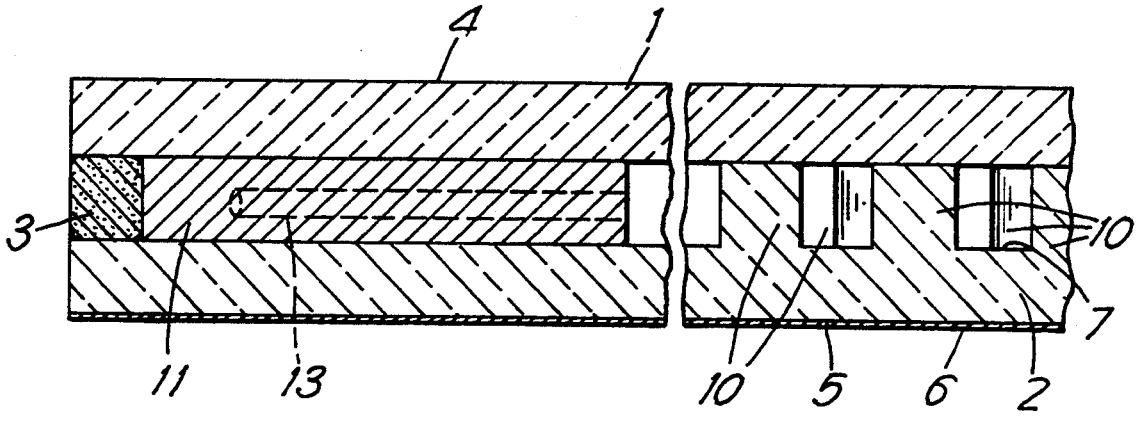
FIG. 2 is a sectional side elevation view of a part of the lamp.

The lamp is in the form of a light-emitting panel comprising two rectangular glass plates 1 and 2 both of which are transparent to light. A thick glass seal 3 is formed around the edge of the panel between the plates 1 and 2. The outer surface 4 and 5 of both plates 1 and 2 is flat and planar. The surface 5 of the lower plate 2 carries a metal coating 6, which acts as a conducting backplane and also as a reflector. The metal layer 6 could, alternatively, be transparent and have a white or colored diffuse reflector layer on its external surface. In another arrangement, a white or colored reflecting layer could be located between the metal layer and the lower plate. This reflecting layer could be a specularly reflecting layer, formed by deposition, or a diffusely reflecting layer such as, for example, formed by a bonded ceramic tile.

The inner surface 7 of the lower plate 2 is interrupted by an array of pillars 10. The pillars 10 are square in section being typically of width 0.707 mm giving a diagonal diameter of -1 mm, with vertical walls and a height of 1 mm. The pillars 10 are diagonally arranged in straight rows, horizontal in FIG. 1, with the spacing between adjacent pillars in a row equal to the diagonal of the pillars. Pillars 10 in adjacent rows are staggered from one another by a distance equal to the diagonal of the pillars, so that the pillars 10 of one row are aligned midway between pillars of an adjacent row. The edges of adjacent rows are contiguous so that there is no space between adjacent rows.

The floor of the lower plate 2, between the pillars 10 may be profiled with V-shape channels so as to increase the amount of light reflected into the pillars.

The upper plate 1 is flat and is supported by the top of the pillars 10. The two plates 1 and 2 are joined by an adhesive of refractive index matched to that of the glass forming the plates.

The light-emitting panel includes two electrodes 11 and 12 extending along opposite sides of the panel. Both electrodes 11 and 12 are identical, being made from a solid rectangular block of a metal such as NILO 48 or molybdenum, which is about 160 mm long, 0.75 mm wide and 5.5 mm deep. Each electrode 11 and 12 has a row of cylindrical holes 13 of circular section spaced along its length that open into the gas-discharge volume of the lamp. The holes 13 have a diameter or width less than the width of the electrode, being about 0.45 mm and being inclined at an angle $\alpha$ of 25–35 degrees to the normal N to the front surface 14 of the electrode. The two electrodes 11 and 12 are identical, one electrode being turned upside down relative to the other electrode so that the holes 13 are inclined in opposite senses.

Figure 3:
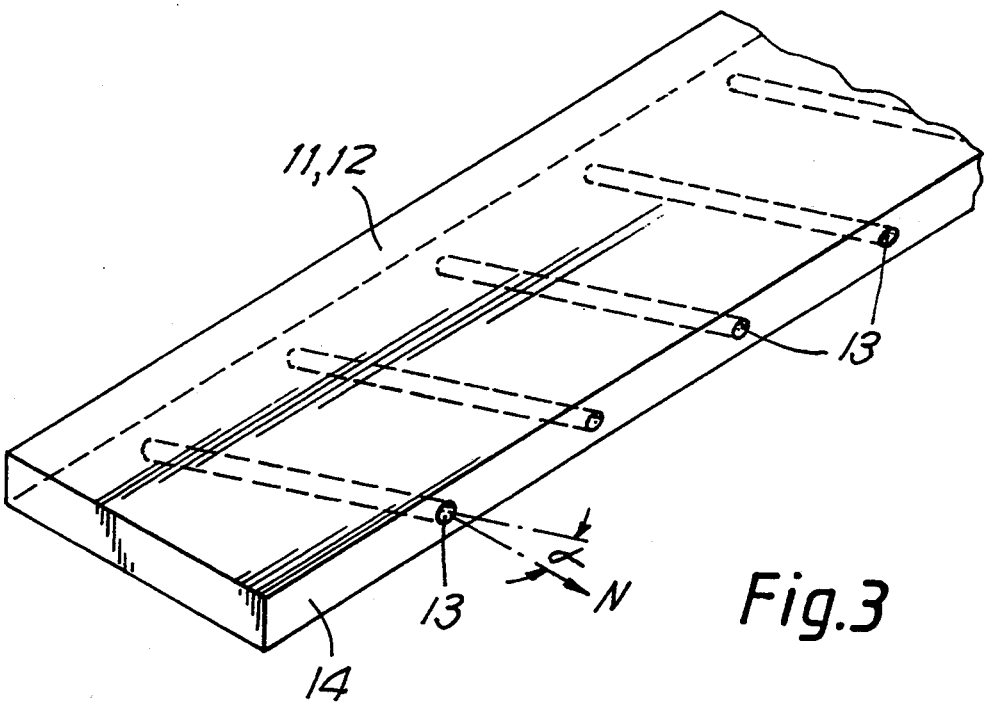
FIG. 3 is a perspective view to an enlarged scale of a part of one electrode of the lamp.

The holes 13 are blind, extending only a part way through the depth of the electrode, to within about 1 mm of its rear surface. The spacing between the holes 13 has been exaggerated in FIG. 3 of the drawing; in practice the spacing is approximately equal to the diameter of the holes as shown in FIG. 1. The holes 13 are formed by laser machining and it has been found that, by using a copper vapor laser, holes with a high aspect ratio can be made with sufficient accuracy.

This form of electrode configuration has been found to be particularly advantageous in flat panel discharge lamps because the holes generate a distributed negative glow over a long length of electrode surface, leading to a very even illumination over the surface of the lamp.

The supporting pillars 10 give the lamp an advantage, in that, the row of pillars adjacent the electrodes serves as a mesh on which any sputtered material is deposited. This reduces the contamination of the light-emitting area.

The electrode of the present invention has advantages over electrodes with slots of the kind described in GB 2244855 in that sputtering of the electrode material is almost entirely confined to within the holes 13 themselves, with very little sputtered material being deposited on the glass plates. The efficiency of the electrode is also improved because the emitter part of the electrode, within the holes, is entirely surrounded by conductive material, whereas, with a slot, it is only bordered on two sides with conductive material.

It is not essential for the electrode to be of a metal since electrodes can be made of other electrically-conductive materials, such as, for example, suitably doped semiconductive materials.

What I claim is:

1. An electrode for a planar cold-cathode discharge lamp, wherein the electrode comprises an elongate block of electrically-conductive material having a front surface, a length, a width at right angles to said length, and a depth extending at right angles to said front surface, and wherein the block has a plurality of holes, said holes being located side-by-side along the length of the electrode and opening on the front surface of the electrode, and wherein each hole has a width less than the width of the electrode.

2. An electrode according to claim 1 wherein the holes have a spacing between adjacent ones of said holes in a direction along the length of the electrode that is substantially equal to their width.

3. An electrode according to claim 1, wherein the holes are of circular section.

4. An electrode according to claim 3, wherein the holes have a diameter of about 0.45 min.

5. An electrode according to claim 1, wherein the holes extend at an angle away from the normal to the front surface of the electrode.

6. An electrode according to claim 5, wherein the angle is between about 25 and 35 degrees.

7. An electrode according to claim 1, wherein the holes extend only a part way through the depth of the block.

8. An electrode according to claim 1, wherein the holes are formed by laser machining.

9. An electrode for a planar cold-cathode discharge lamp comprising an elongate block of metal of rectangular section, said block having a front surface arranged to face towards a discharge in the lamp, said front surface having a length and a width at right angles to said length, a plurality of holes extending part way into the block at an angle inclined away from a normal to the front surface, each hole having a diameter less than the width of the block.

10. A discharge lamp having two electrodes and two plates enclosing a gas-discharge volume, wherein at least one of the electrodes is an elongate block of electrically-conductive material having a front surface which has a length dimension and a width dimension at right angles to said length dimension, said electrode having a plurality of holes that are located side-by-side along the length of the electrode, each hole having a width less than the width of the electrode.

11. A discharge lamp according to claim 10 wherein said two electrodes are formed by respective blocks of electrically-conductive material each having a front surface and a plurality of holes located side-by-side along the length of the electrode, each hole having a width less than the width of the electrode.

12. A discharge lamp according to claim 11 wherein said holes in each electrode extend at an angle away from a normal to said front surface of the electrode, and wherein the holes in the two electrodes are respectively inclined away from one another.

* * * * *